US007350473B2

(12) United States Patent
Henry

(10) Patent No.: US 7,350,473 B2
(45) Date of Patent: Apr. 1, 2008

(54) METHOD AND GRID FOR TYING LAYERS OF A QUILT

(76) Inventor: Evelyn Henry, 5807 Green Falls Dr., Houston, TX (US) 77088

( * ) Notice: Subject to any disclaimer, the term of this patent is extended or adjusted under 35 U.S.C. 154(b) by 139 days.

(21) Appl. No.: 11/018,031

(22) Filed: Dec. 21, 2004

(65) Prior Publication Data

US 2006/0130723 A1 Jun. 22, 2006

(51) Int. Cl.
*D05B 11/00* (2006.01)
*D05B 23/00* (2006.01)

(52) U.S. Cl. ..... 112/475.08; 112/117

(58) Field of Classification Search ..... 112/475.08, 112/475.18, 117, 119, 136, 131, 260; 33/2 R, 33/4–6, 11–13, 17 R
See application file for complete search history.

(56) References Cited

U.S. PATENT DOCUMENTS 1,293,313 A * 2/1919 Berkoff ..... 33/566
2,077,772 A * 4/1937 Ring ..... 33/13
4,608,939 A * 9/1986 Lampley ..... 112/260
5,319,859 A * 6/1994 Smith ..... 33/563
5,749,149 A * 5/1998 Claytor ..... 33/1 F
6,155,189 A * 12/2000 Walner ..... 112/475.01
6,321,458 B1 * 11/2001 Hess ..... 33/566
6,413,091 B1 * 7/2002 Fields ..... 434/95

* cited by examiner

*Primary Examiner*—Ismael Izaguirre
(74) *Attorney, Agent, or Firm*—Darcell Walker

(57) ABSTRACT

The present invention simplifies the process of placing quilt ties in the quilt during the quilt making process. The quilt tie device contains a plurality of openings that identify locations in the quilt for quilt ties. A quilt maker places the quilt tie device over a top layer of the quilt. The quilt tie device is positioned such that the openings in the device are at locations on the quilt where the maker desires to place quilt ties. The quilt maker performs the quilt tie operation by tying a quilt tie in the quilt layer at each location in the quilt that indicated by an opening in the quilt tie device.

8 Claims, 3 Drawing Sheets

METHOD AND GRID FOR TYING LAYERS OF A QUILT

FIELD OF THE INVENTION

The present invention relates to a method and quilt grid used in the process of making a quilt and in particular to a method and quilt grid used to mark locations for placing ties in the process of tying layers of a quilt together.

BACKGROUND OF THE INVENTION

A quilt is a padded needlework covering made of at least three layers of fabric. Silk, cotton, wool or a similar fabric may be used for the front and back layers. The interlining (middle layer) may be of wool, cotton, or kapok. Quilting is usually used for bed coverings. When a quilt is sewed together, the three layers are usually stretched over a quilting frame to keep the fabrics smooth and in shape. The stitches follow a designed marked on the top layer. Small stitches are used so that the interlining will not slip. The edges are bound with bias strips or cloth.

Colorful geometric or floral patterns may decorate the top of a quilt. Two common methods of design are piecing and appliqué. The top of a pieced quilt is made of many small pieces of fabric sewed or pieced together to form a pattern. A jumble of odd-shaped patches haphazardly sewed together forms a "crazy quilt". In an appliqued quilt, cutout cloth designs are sewed or embroidered on the quilt top.

Although a large proportion of quilting that is currently performed both commercially and in the home is through the use of a sewing machine, there are still a large number of hand-sewn quilts. These types of hand sewing activities are extremely tedious. In addition, hand sewing is virtually impossible for persons with visual handicaps. Those with some sight can use a magnifying glass, for example, but those with very limited or no sight are precluded from hand sewing in general.

A conventional quilt making process comprises four basic steps: 1) cutting squares, 2) designing the layout of squares, 3) sewing the squares together to create quilt layers and 4) quilting the layers together. In the quilting process, the quilt is pieced from individually cut squares of fabric. A typical quilt can be 5 feet by 5 feet with a total of 169 square pieces. The squares are cut from various pieces of fabric. After cutting the squares, the quilt maker lays out the squares of fabric to form the design of the quilt in a variety of ways. The maker can lay out the squares on a large surface and carefully arrange them in any desired pattern. This method of laying out squares is tedious but can yield a very even distribution of the different fabrics through the quilt. The third step is sewing the squares together. This sewing step comprises two basic steps: 1) sew squares together with a seam allowance to form strips of squares; and 2) sew strips of squares together along their long sides to form a surface. Many quilters consider this to be the most important step of their quilting.

The fourth step is to assemble the layers of the quilt and sew through them. In this step, first lay out the quilt backing, right side down. On top of the quilt backing, lay out the batting. On top of the batting, lay out the pieced top, right side up. Align it to the backing if desired. Ideally, there should be several inches of both backing and batting sticking out from under the pieced top on all sides. Pin with safety pins through all layers of the quilt. The recommendation is to place a minimum of one safety pin in the center of every third square of every third row. Better, place a safety pin in the center of each square. The more pins you have in the quilt, the more stable the layers are together, and the fewer problems the whole thing will give you in the quilting process.

In the assembling step, the task of pinning the layers is a tedious ordeal. The quilt maker individually marks the locations and applies the pin at that location. Many times it is necessary to measure each pin location before applying the pins. There remains a need for a device that can simplify the process of identifying the locations for pins during the process of assembling the layers of a quilt.

SUMMARY OF THE INVENTION

It is an objective of the present invention to provide a method for placing ties in the quilt during the quilt making process without the need to measure the location for each quilt tie.

It is a second objective of the present invention to provide a quilt grid device for use in quilt making that simplifies the process of placing ties in the quilt during the quilt making process.

It is a third objective of the present invention to provide a means to identify locations on the top layer of the quilt for quilt ties without the need to measure the location for each quilt tie.

It is a fourth objective of the present invention to provide a means to secure the quilt grid device to the quilt during the process of placing quilt ties in the quilt.

The present invention provides a device and method for simplifying the process of placing quilt ties in the quilt during the quilt making process. The quilt-making device comprises a flat and sturdy but flexible material containing a plurality of opening in the material. The openings in the material identify locations in the quilt for quilt ties. The quilt ties secure the layers of the quilt together. The openings in the quilt-making device of the present invention are measured in order to ensure that there will be proper spacing between the quilt ties. The pre-measured openings eliminate the need for the quilt maker to hand measure each quilt tie location.

In the method of present invention, the quilt maker places the quilt tie device over a top layer of the quilt. The quilt tie device is positioned such that the openings in the device are at locations on the quilt where the maker desires to place quilt ties. The quilt maker performs the quilt tie operation by tying a quilt tie in the quilt layer at each location in the quilt that indicated by an opening in the quilt tie device.

DETAILED DESCRIPTION OF THE INVENTION

Figure 1:
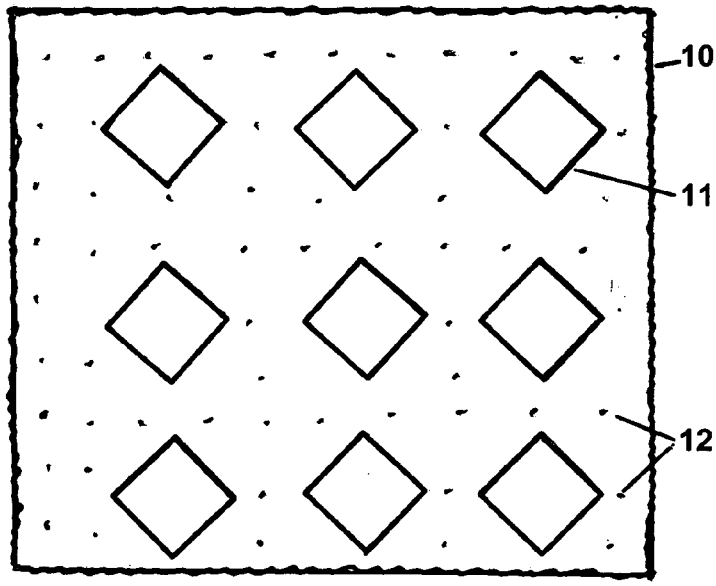
FIG. 1 is an illustration of a top layer of a quilt.

The present invention provides a device and method for simplifying the process of placing quilt ties in the quilt during the quilt making process. Referring to FIG. 1, shown is a quilt design 10. Quilts are commonly constructed of at least two fabric layers with thermal insulation contained between the layers. As shown, the quilt has individually cut fabric pieces 11 that comprise the top and bottom layers. The quilt has a series of parallel stitches, which run through the layers in order to prevent undesirable movement of the insulation between adjacent tubes. The insulation tends to migrate within a tube during use and accumulate in dense clumps in comers. Within the quilt layers are a plurality of ties 12 that are used to connect the layers of the quilt. Although present in the quilt, these ties are usually undetectable by most people. As mentioned, in the conventional method of quilt-making, these ties are manually incorporated into the quilt. The quilt maker hand measures the location for each quilt tie. This method is very tedious and time consuming.

Figure 2:
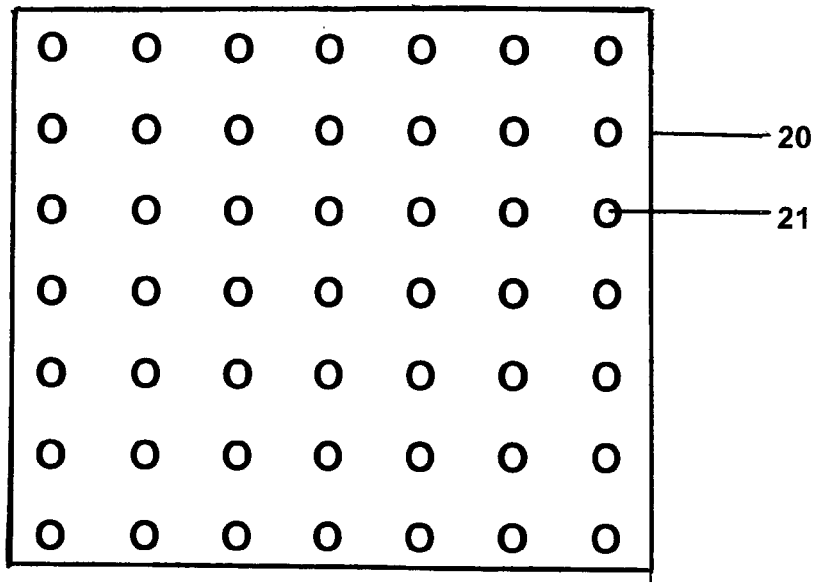
FIG. 2 is an illustration of a quilt grid in accordance with the present invention.

Referring to FIG. 2, shown is a quilt grid in accordance with the present invention. This grid 20 can have the shape that resembles the typical shape of a quilt, which is a generally square shape. The grid is a material that has flat top and bottom surfaces. Within the surface is a plurality of openings 21. The openings are pre-measured in order to achieve adequate spacing between the ties. The adequate spacing is necessary in order to enable the support be properly distributed the ties. The grid fits ideally over the top layer of the quilt. The material that comprises the grid should have flexible but sturdy characteristics. The sturdiness of the material can be such that the weight of the material is sufficient to prevent the grid from moving during the quilt tying process. The material flexibility provides ease when the packaging and transporting the grid. For example, preferably, the grid has the capability of being folded for packaging and storing the grid. In addition, the grid can also be unfolded and placed over the quilt for the purpose of incorporating the quilt ties. For example, the grid material could be a sturdy plastic or even a fiberglass type material. It is also desirable to have the clear grid to enable to quilt maker to view the entire quilt during this tying process.

Figure 3:
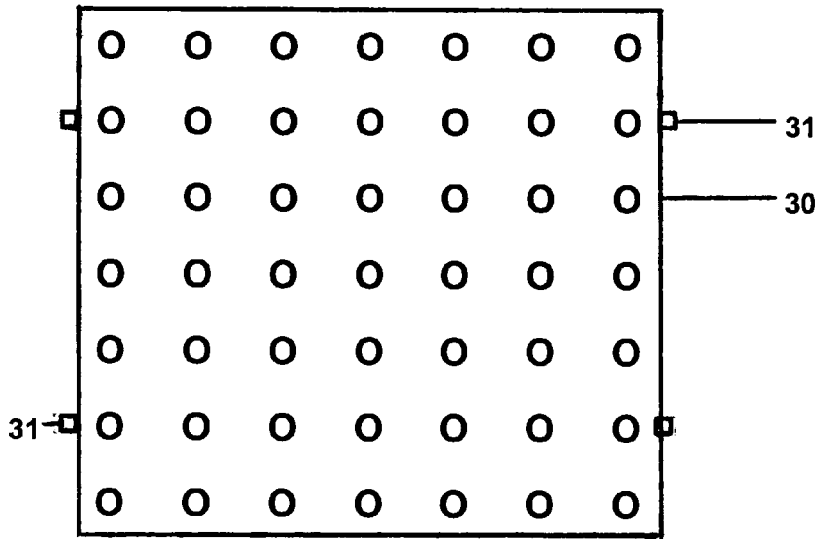
FIG. 3 is an illustration of a quilt grid with means for securing the quilt grid to the quilt in accordance the present invention.

FIG. 3 shows an alternate embodiment the quilt guide 30 of the present invention, which has means 31 to attach the quilt grid to the quilt. In this embodiment, there is little to no need for the weight characteristic, which assists in the securing of the grid to the quilt. The flexibility characteristic is still preferred with this embodiment. The attachment means can be clips or other attachment devices. The attachment means would attach to the ends of the quilt.

Figure 4:
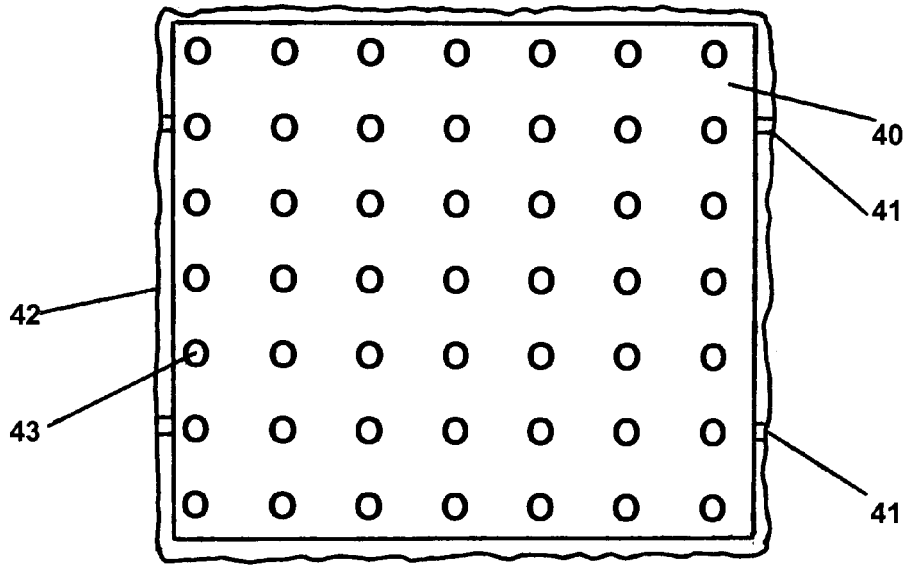
FIG. 4 is an illustration of the quilt grid of the present invention secured over the top the layer of a quilt such that the openings in the quilt grid indicate location to place quilt ties.

FIG. 4 is an example of the quilt grid placed over the quilt during the quilt tying process. In this example, the quilt grid 40 has attachment means 41 to secure the grid to the quilt 42. In the quilt making process, the quilt maker would insert the ties through the openings 43 in the quilt grid. As shown, these arranged openings eliminate the need to measure the location for each quilt tie.

Figure 5:
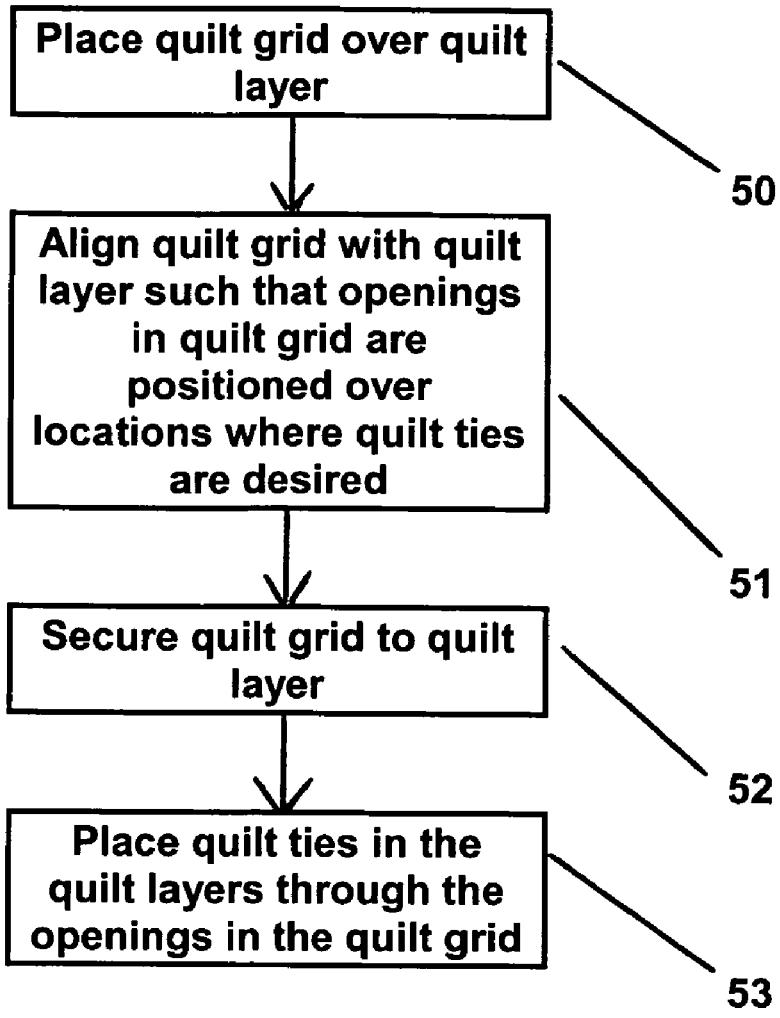
FIG. 5 is a flow diagram of the basic steps of a quilt tying method using the quilt grid of the present invention.

FIG. 5 is a flow diagram of the basic steps of a quilt tying method using the quilt grid of the present invention. When the quilt maker is ready to incorporate the quilt ties, in step 50 the quilt maker places the quilt grid over the top layer of the quilt. The next step 51 is to align the quilt grid with the quilt layer such that the openings in the quilt grid are positioned over the locations of the quilt where the maker desires to incorporate the quilt ties. Step 52 secures the quilt grid to the quilt layer. Depending on the embodiment of the quilt grid, this step may be incorporated into the aligning step 51. If the quilt guide is an embodiment that has attachment means (FIG. 3), step 52 attaches the quilt grid to the quilt. Once the quilt grid is secured to the quilt, step 53 places the quilt ties in the quilt through the openings in the quilt guide. As mentioned, this method eliminates the need to measure each quilt location. As a result, the use of the quilt of the present invention reduces the amount of time needed to perform the quilt tying process.

It is important to note that while the present invention has been described in the context of the preferred embodiment for construction and use of the device. The quilt tie device can have various designs. Therefore, there can be various designs to the quilt tie device of the present invention to accommodate the desires of a particular user. Those skilled in the art will appreciate the alternate embodiments of the present invention. Those skilled in the art will also appreciate and recognize that there may be ways to improve upon the design and implementation of the device of the present invention. Therefore, it is not desired to limit the invention to the specific construction and implementations described and shown herein. Accordingly, those skilled in the art may make changes and modifications to the device of the present invention that are within the spirit and scope of the present invention as described in this document. The present embodiment is, therefore, to be considered as merely illustrative and not restrictive. The scope of the invention is indicated by the claims that follow rather than the foregoing description, and all changes, which come within the meaning and range of equivalence of the claims, are embraced therein.

I claim:

1. A method for making quilts comprising the steps of:

cutting squares of fabric that will form the top layer of the quilt;

designing the layout of squares on the top layer of the quilt;

sewing the squares together to create quilt layers; and quilting the layers together by placing a quilt grid device over a top quilt layer and tying the layers of the quilt together by placing quilt ties through each layer of the quilt through openings in the quilt grid device.

2. The method as described in claim 1 wherein said quilting layers together step further comprises:

aligning the quilt layers before placing the quilt grid device over the top quilt layer and securing an edge of the quilt grid device to edges of the quilting layers.

3. The method as described in claim 1 wherein said quilting layers together step further comprises positioning a plurality of quilt layers together such that edges of the quilt layers are aligned.

4. The method as described in claim 3 wherein said quilting layers together step further comprises placing on the plurality of quilt layers a quilt grid device, the quilt grid device having at least one edge and a plurality of openings through the device that identify locations for quilt ties.

5. The method as described in claim 4 wherein said quilting layers together step further comprises aligning the quilt grid device with the quilt layers such that the openings in the quilt grid are positioned over locations where quilt ties are desired.

6. The method as described in claim 4 wherein said quilting layers together step further comprises securing the quilt grid device to the quilt layers by securing the edges of the guilt layers to the at least one edge of the quilt grid device.

7. The method as described in claim 6 wherein said securing step further comprises clamping a quilt grid device edge to an edge of the quilt layers.

8. The method as described in claim 6 wherein said securing step further comprises pinning a quilt grid device edge to an edge of the quilt layers.

* * * * *